United States Patent [19]

Sukup

[11] 3,946,496

[45] Mar. 30, 1976

[54] CONTROL SYSTEM FOR GRAIN DRYING BIN

[76] Inventor: Eugene G. Sukup, Dougherty, Iowa 50433

[22] Filed: May 5, 1975

[21] Appl. No.: 574,831

Related U.S. Application Data

[63] Continuation-in-part of Ser. No. 445,641, Feb. 25, 1974, abandoned.

[52] U.S. Cl. ..... 34/56; 214/17 A; 214/17 DA

[51] Int. Cl.[2] ..... F26B 13/10

[58] Field of Search ..... 214/17 A, 17 CA, 17 D, 214/17 DA; 34/52, 56; 236/99; 73/349, 351

[56] References Cited

UNITED STATES PATENTS

| | | | |
|---|---|---|---|
| 1,758,532 | 5/1930 | Phinney | 73/349 |
| 3,092,472 | 6/1963 | Figley | 34/56 |
| 3,532,232 | 10/1970 | Sukup | 214/17 DA |
| 3,714,718 | 2/1973 | Sukup | 34/56 |

*Primary Examiner*—Carroll B. Dority, Jr.
*Assistant Examiner*—Larry I. Schwartz
*Attorney, Agent, or Firm*—Neuman, Williams, Anderson & Olson

[57] ABSTRACT

A control unit sensitive to the condition of its ambient atmosphere is enclosed within an insulated housing over lateral openings in the discharge auger tube of a grain drying bin whereby gases surrounding the discharged grain circulated into contact with said unit. The unit is connected to control the operation of the discharge auger, thereby controlling the moisture content of grain being discharged. In one embodiment, a warm-air circulation jacket is disposed about the control unit housing to establish a constant housing temperature and obviate any temperature effects of the exterior atmosphere.

10 Claims, 9 Drawing Figures

FIG. 1
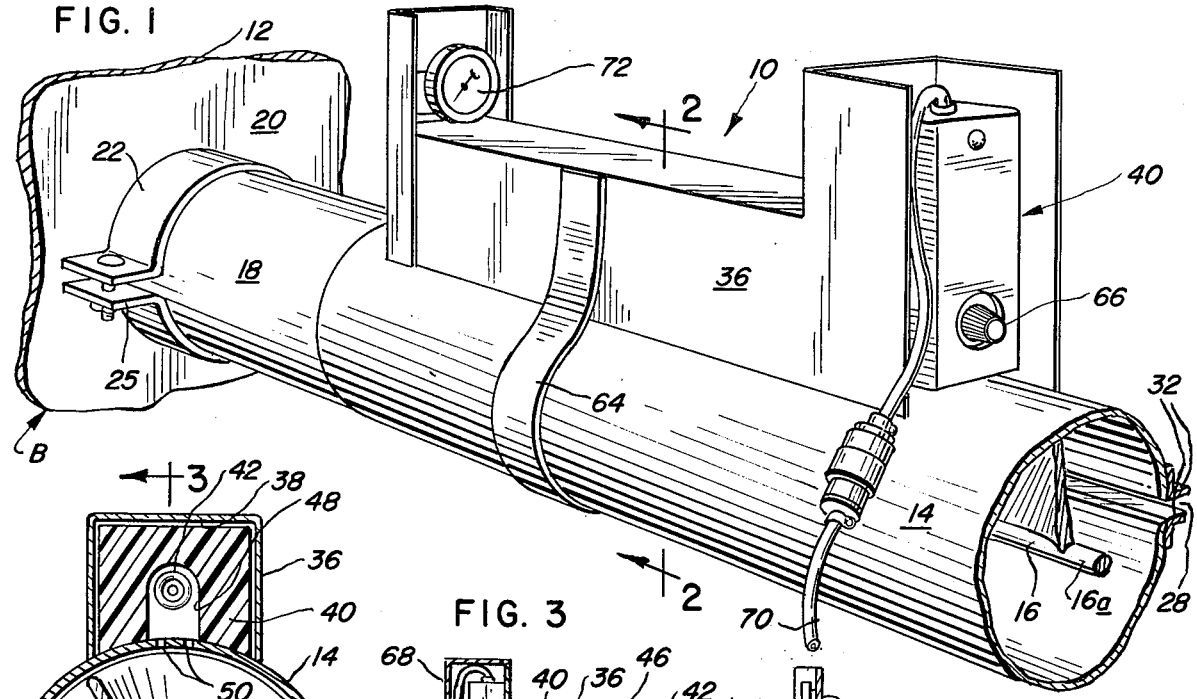
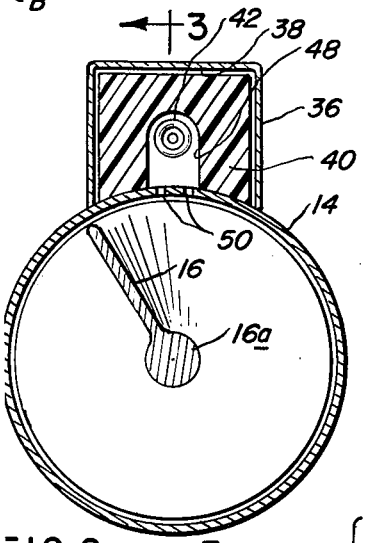
FIG. 2
FIG. 3
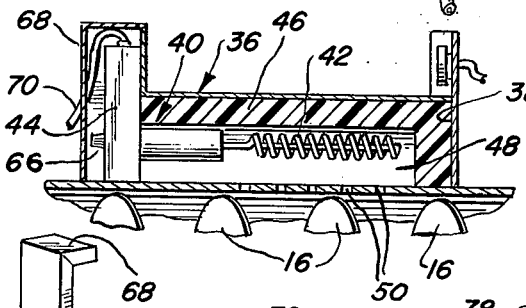
FIG. 4
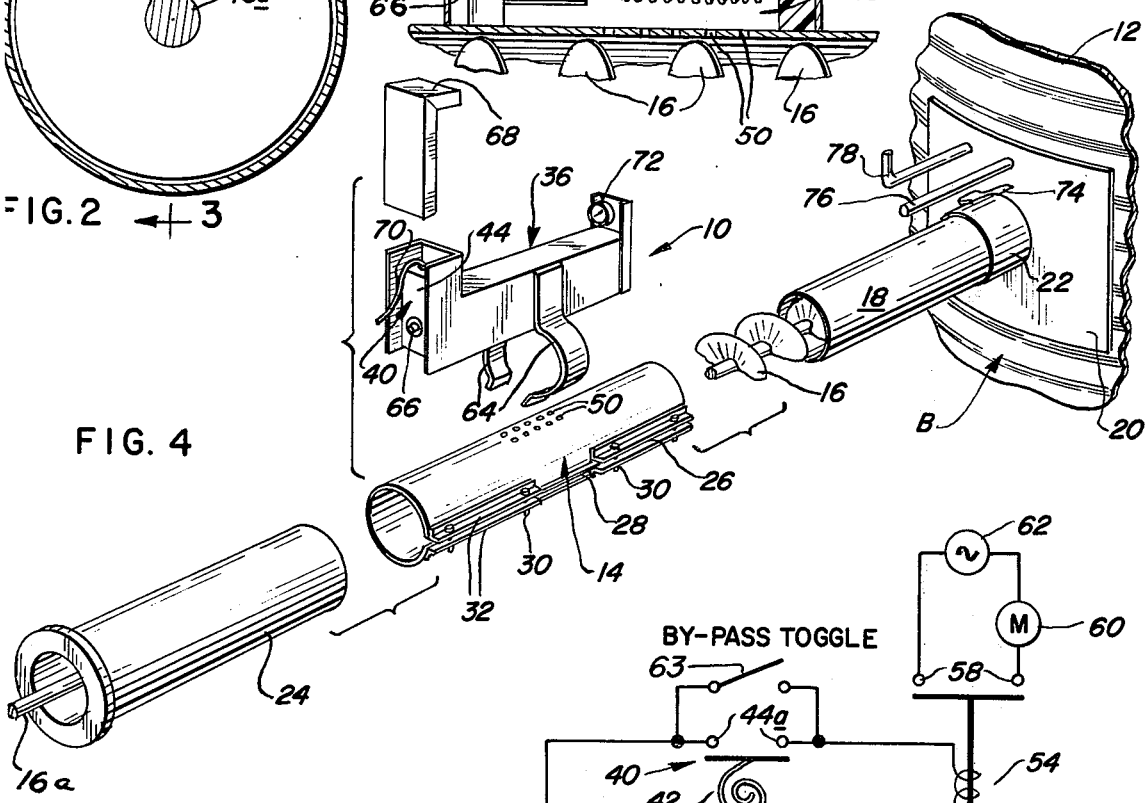
FIG. 5
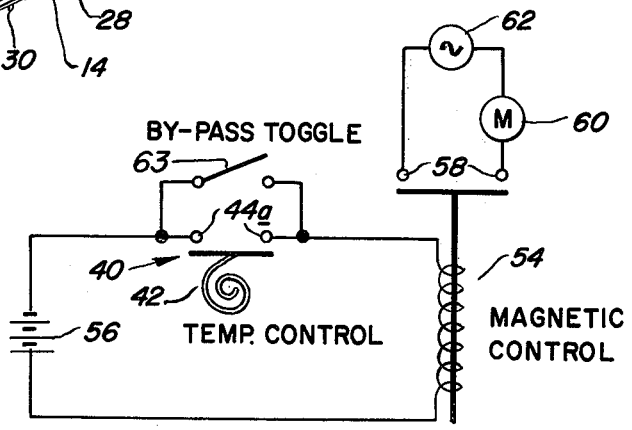

CONTROL SYSTEM FOR GRAIN DRYING BIN

This invention relates to a system for controlling the removal of grain from a drying bin in accordance with the moisture content of the grain and is a continuation-in-part of any copending application Ser. No. 445,641 filed Feb. 25, 1974 now abandoned. More particularly, this invention pertains to improvements in control systems for drying bins of the type disclosed and claimed in my U.S. Pat. No. 3,714,718.

A common form of grain drying bin for use in reducing the moisture content of grain or other granular material comprises a foundation, an upstanding cylindrical wall and a conically-shaped roof. A floor pervious to the flow of drying gas is supported above the foundation and forms a plenum chamber. The heated air or other drying gas is passed into the plenum chamber and passes through the pervious floor up through the interstices between the granular material and out through an opening in the conical roof. The bin employs a central pit or sump from which a screw conveyor or other form of conveyor passes grain to the exterior of the bin for further storage or processing.

Bins of the foregoing type are described in my U.S. Pat. Nos. 3,532,232 and 3,714,718, which bins also employ a plurality of radially extending sweep augers disposed atop the bin floor. The sweep augers are rotatable about their longitudinal axes and move the grain layer disposed adjacent the floor surface into the sump; the sweep augers simultaneously rotate about the top of the sump for uniform grain removal into the sump. A screw conveyor having an entrance opening in the sump discharges dried grain from the sump to the bin exterior.

Various apparatus have been employed in the prior art to assure the proper moisture content of the dried grain being removed from the bin. Unless the grain is dried to a proper desired moisture content, difficulties will ensue. The stored grain may deteriorate if the moisture content is allowed to remain at an excessively high level. On the other hand, excessive drying of the stored grain can result not only in reduced market value and grain damage but also in wasted processing time and fuel.

One type of control for moisture content control of material being dried comprises an appropriate sensor placed in the mass of the material or at another location within the storage bin interior. Such control has been subject to operational deficiencies relating to the differences in grain moisture content between the location of the temperature sensor and the location of the grain which is discharged from the bin by the discharging conveyor system. In my U.S. Pat. No. 3,714,718 a discharge control for use with a grain drying bin is provided in which a sensing element is disposed so as to be contacted by a portion of the gas accompanying the grain discharged from the bin through the discharge conveyor. In particular, a humidity sensor is shown in the upper portion of a housing extension on the outer end of the discharge conveyor. The sensor, in turn, controls actuation of the grain discharging conveyor. In a commercial embodiment, the sensor was located in an open housing positioned atop the outer end of the conveyor housing over holes in the conveyor housing. Gases escaping from the bin through the conveyor passed outwardly through the holes and through the sensor housing, around the sensing elements to the atmosphere. Because of the disposition of the sensor exteriorly of the bin and in an open housing, the effect of the gas accompanying the discharged grain on the sensing element was effected by the ambient atmospheric conditions about the sensor housing. This had an adverse effect on the overall accuracy of the control unless compensating adjustments were made in the control settings. The more extreme the temperature variation exteriorly of the storage bin, the more frequently adjustments were required, or the more significant the inaccuracy in the operation of the sensor became.

It is an object of this invention to provide control for the discharge conveyor of a grain drying bin which consistently operates with accuracy despite the nature of the ambient temperatures surrounding the drying bin.

It is another object of this invention to provide a control system for use with grain drying bins which may readily be installed on bin constructions in the field with a minimum of time and effort.

It is still another object of this invention to provide a discharge control for use with grain drying bins composed of a minimum number of inexpensive elements which are readily available and of a simple nature.

It is a further object of this invention to provide a discharge control for use in grain drying bins which may employ the heated atmosphere of the bin itself to maintain a constant temperature for a sensor element housing located externally of the bin whereby the effects of ambient atmosphere on the sensor element are negated.

The above and other objects of this invention will become more apparent from the following detailed description when read in the light of the appended claims and accompanying drawing.

In accordance with one illustrative embodiment of this invention, operation of the discharge conveyor is controlled by a temperature sensing element disposed in an insulated chamber which is closed to the ambient atmosphere and thus is substantially unaffected by ambient temperature conditions exterior of the storage bin; such element is in direct contact with gases surrounding the discharged grain in a discharge conduit. The discharged grain and gases are of substantially the same temperature, thus the temperature of the gases is the temperature of the grain and indicative of the moisture content of the grain. The location of the temperature-sensing element in a closed housing or chamber whereby the temperature sensed is solely that of the gases surrounding the discharged grain assures discharge of grain having the precise moisture content desired.

Also, in accordance with this invention, the sensing element may be a humidity sensor disposed within said insulated housing so as to sense the humidity of the gases surrounding the discharged grain in a discharge conduit. Since the gases surrounding the grain being discharged possess a moisture level indicative of the grain moisture content, the moisture in the gases sensed by a humidity sensor may also serve to drive the discharge conveyor within desired limits of moisture content of the grain being discharged.

In a still further embodiment of this invention, the housing for the gas condition sensor is surrounded by an outer jacket or shell through which gases from the bin plenum chamber at a substantially constant temperature circulate to maintain a constant temperature in such jacket, thereby eliminating temperature change in the sensor housing occasioned by the ambient atmosphere external of the unit. In a modification of the latter embodiment of this invention, an insulation shell may be employed in combination with the constant-temperature circulating layer to diminish the effects of the ambient atmosphere on the discharge conveyor gases sensed by the condition sensor. The insulation shell is particularly adapted for use where there is a large gradient between the ambient temperature and that of the grain in the discharge conveyor.

In another embodiment of my invention, electrical resistance heaters adapted to provide a constant temperature in an insulated shell surrounding the sensor housing may be employed to obviate effects of external ambient atmospheres.

Referring now to the embodiments illustrated in greater detail in the drawing by way of examples of the provided invention, FIG. 1 is a perspective view of a discharge control assembly employing teachings of this invention;

FIG. 2 is a transverse sectional view of the control of FIG. 1, taken generally along line 2—2 of FIG. 1, illustrating the disposition of the temperature sensing element in an insulated housing disposed atop the discharge auger housing;

FIG. 3 is a partial longitudinal sectional view taken generally along line 3—3 of FIG. 2;

FIG. 4 is a fragmentary exploded view illustrating various elements of one embodiment of a control made in accordance with this invention and apparatus components normally associated therewith;

FIG. 5 is a schematic wiring diagram relating to the provided control of this invention.

Figure 7A:
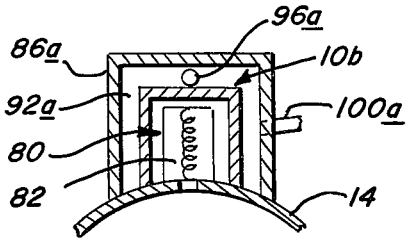
FIG. 7 is a view similar to FIG. 3 illustrating an outer gas flow jacket disposed about an inner insulated sensor which jacket is adapted to negate the temperature effects of the atmosphere external of the unit illustrated.
Figure 7:
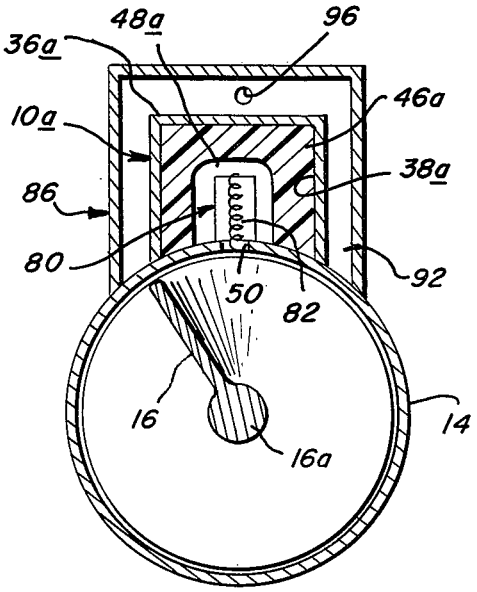

FIG. *7a* is a fragmentary sectional view illustrating a gas circulation jacket disposed about a sensor housing, and FIG. *7b* is a view similar to FIG. 7 in which an outer insulating layer as well as an inner jacket surround a sensor housing.

Referring now to FIG. 1, a control 10 for regulating the discharge of grain through wall 12 (see FIG. 4) of a drying bin B is illustrated in the normal position of use mounted atop a conveyor housing section 14. A typical grain drying bin and associated equipment with which the control of this invention is adapted to be used is more fully described in my U.S. Pat. No. 3,714,718. Briefly, a power driven rotatable auger 16 is adapted to move grain along a conveyor tube or housing 18 from a central sump within the bin B through connecting plate 20 and sleeve 22 secured to bin wall 12, and outward through the conveyor housing section 14, and through an outer end section 24 which may communicate with a dry grain collection receptacle or a further conveyor for removal to a storage bin in a conventional manner. It will be noted from FIG. 1 that split clamp 25 assists in securing the conveyor tube in place. Mounting section 14 is longitudinally split at 28 to facilitate clamping about the telescopically received end portion of tube 18 and end section 24. Nut and bolt elements 30 urge spaced flanges 32 of mounting section 14 toward each other so that section 14 may be securely clamped to the received conduit sections 18 and 24.

The control 10 includes an elongated control housing 36 mounted atop the conveyor housing section 14. Housing 36 is formed of a material which is impervious to air, such as sheet metal, and includes side, top and end walls as shown. Housing 36 fits the contiguous wall of section 14 to define therewith, within the housing 36, a longitudinally extending chamber 38. A temperature-responsive control unit 40 is mounted in the housing 36. The unit 40 includes a temperature-sensing element or probe 42 and appropriate transducer apparatus in a housing 44 for operating a switch in accordance with the temperature condition being sensed. By way of specific example, a commercially available thermostatic control unit sold by Penn Controls of Goshen, Indiana under the designation "Type A19EAF" has been used satisfactorily. This unit is mounted such that housing 44 closes the otherwise open mounting end of chamber 38 in which the probe 42 is disposed.

An efficient thermal insulation material 46 such as foamed plastic also is disposed in housing 36, about element 42 and is adapted to insulate element 42 from the temperature of the atmosphere surrounding housing 36. As illustrated, the material 46 may be formed to substantially fill the chamber 38 and to conform to the housing 14 at its inward side, defining an elongated insulated cavity 48 which is U-shaped in cross section and open along the wall of housing 14.

Apertures 50 are disposed in the upper central surface portion of mounting section 14 within the areas defined by the open side of cavity 48 as shown in FIGS. 2 and 3. These apertures allow gas surrounding the grain being discharged from the drying bin through the conveyor tube portions 18-14-24 to freely circulate in longitudinal chamber 38 and more particularly in cavity 48. Since housing 36, and particularly cavity 48, is essentially closed to external ambient air, the thermally-responsive element 42 accurately senses the temperature of the gas in the conveyor tube.

During the drying operation, the drying gases are constantly introduced into the bin, creating a positive pressure therein. Moreover, since the cross section of a conveyor such as auger conveyor 16 is never completely filled by the material being conveyed, a portion of the drying gas escapes through the grain in the sump and outwardly through the discharge conveyor tube. The temperature of this escaping gas is indicative of the moisture content of the grain through which it has passed, in accordance with known principles of drying operations. Accordingly, the temperature of the gases entering chamber 38 through openings 50 is indicative of the moisture content of the grain in the sump from which auger 16 extends and in the auger tube. Since sensor element 42 is isolated from ambient temperature conditions, the element 42 thus is sensitive to and affected solely by the gases surrounding the grain in position to be discharged by auger 16, and thereby effects control of the drive to auger 16 in accurate response to the moisture content of the specific dried material in position for discharge.

In accordance with this invention, condition sensor unit 42 also may comprise other types of sensors which respond to a condition of the air circulated in the sensor housing that bear a known relationship to the moisture content of the air, or more particularly, of the grain through and with which the air flows. It has been found that use of a humidity sensor at 42 such that unit 40 is responsive to the moisture content of the gases contacting the same may be preferable to a temperature responsive unit in the described assembly 10. However, a humidity sensor senses relative humidity. Moreover, relative humidity of air bearing a given amount of moisture varies significantly with the temperature of the air. Thus whether humidity or temperature of the air is being sensed, it is important that control of the temperature in the sensing chamber be maintained.

An example of the conveyor drive control is illustrated schematically in FIG. 5. It will be noted that control unit 40, upon sensing the desired temperature or humidity indicative of desirably dried grain closes contacts 44*a*. An operating winding 54 of a magnetic control switch thereby is energized from a d.c. power source 56, and closes contacts 58 so as to energize motor 60 from a power source 62. Motor 60 is mechanically connected to rotatably drive discharge auger 16, such as being connected at the outer end of shaft 16*a*. Bypass switch 63 shown in the diagram of FIG. 5 provides for selectively bypassing the control unit 40 for grain discharge from the storage bin regardless of temperature/moisture conditions within the bin.

Clamping arms 64 may be employed to assist in securing control housing 36 for mounting section 14. A mutually-operable thermostat or humidistat dial 66 may be set by the operator as desired to regulate the gas condition at which control 40 will activate motor 60, and thus to regulate the desired moisture content in the discharged grain removed from the bin by auger 16. A protective removable cover 68 may be disposed over the housing 44 after desired adjustment has been made. Electrical cable connection 70 illustrated in FIG. 1 connects the control unit 40 to the electrical circuit control components for energizing motor 60 after element 42 has engaged contacts 44*a*.

A temperature gauge 72 mounted on housing 36 provides a ready visual indication of the temperature in the plenum chamber of the bin, being connected to a sensor such as a thermocouple in the plenum chamber by a suitable cable 74. The shaft shown at 76 is a drive shaft for the sweep augers referred to above, and rod 78 is a control rod for the sweep auger transmission.

Gas-sensitive element 42 disposed in housing 36 is unaffected by temperatures other than that of the gases surrounding the grain discharged by auger 16 and thus is accurately controlled by the grain moisture content only.

Figure 6:
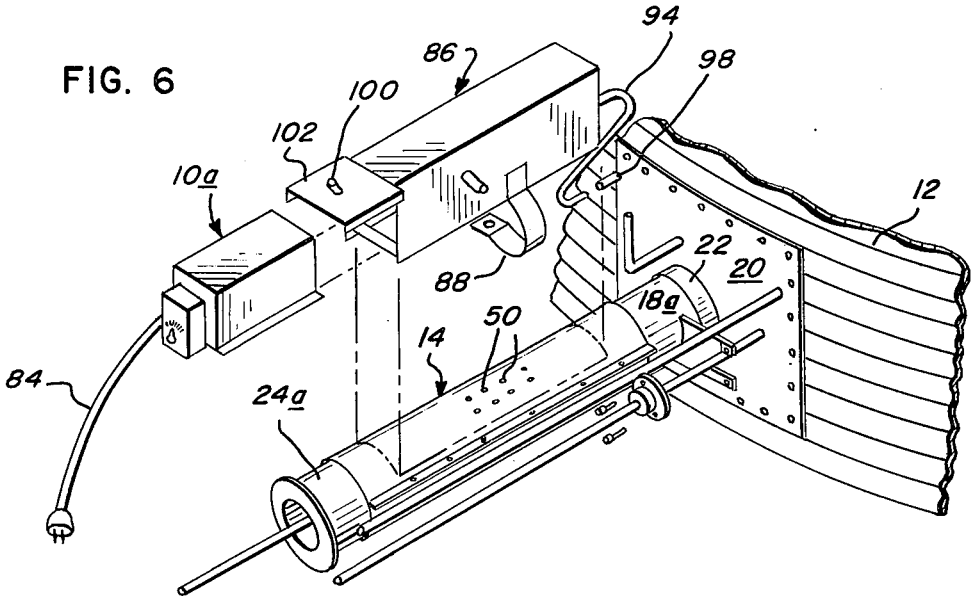
FIG. 6 is a view similar to FIG. 4 illustrating a sensor control housing employing an outer jacket within which gases from the drying bin may circulate.

FIGS. 6 and 7 illustrate a modified control arrangement in accordance with this invention and which utilizes a control 10*a* including a control unit 80 having a sensor element 82 which may be a humidity or temperature sensor. A suitable humidistat control unit which has been used satisfactorily is sold under Model No. H49A 1001 by Honeywell Inc. of Minneapolis, Minn. Control unit 80 has an electrical cable 84 extending therefrom for connection to electrical control circuit elements such as shown in FIG. 5. As above indicated, control units 40 and 80 are interchangeable. In FIG. 6, mounting section 14 is illustrated in assembled relation, with spaced conduit sections 18*a* and 24*a* telescopically received in the opposed ends thereof. Conduit 18*a* is secured in sleeve 22 attached to bin wall plate 20 at one end by means of the split clamp 25 illustrated in FIG. 1, and clamped in the receiving end of longitudinally split mounting section 14.

The control unit 80 includes a housing 36*a* corresponding to housing 36 of unit 40. Housing 36*a* defines with the contiguous wall of section 14 a chamber 38*a* in which sensing element 82 such as a humidity responsive tape is centrally disposed; see FIG. 7. An efficient thermal insulation material 46*a* is disposed about the element 82, defining an inner chamber 48*a* which is of U-shape in section, and is adapted to insulate the sensor from the temperature of the atmosphere surrounding the control 10*a*.

As indicated above, element 82 must sense the temperature or relative humidity of gases reaching central chamber 48*a* (after traversing apertures 50 in section 14) without having the temperature and/or resulting relative humidity modified by temperatures exterior of the control housing 86. In the embodiment of FIGS. 6 and 7 temperature control of the sensor chamber is further insured by including a further housing 86 adapted to surround unit 10*a*. This housing or jacket is received on the upper apertured wall of section 14 and is secured thereto with the assistance of a pair of clamping arms 88 depending from housing 86. Control unit 10*a* is centrally mounted in housing 86 on section 14, as illustrated in FIG. 7. Thus control housing 86 defines in part a gas-circulation jacket space 92 to further insulate the sensor 82 from exterior atmospheric temperature effects. Finally, it will be seen from FIG. 6 that a flexible hose 94 connects jacket inlet 96 (FIG. 7) with a plenum chamber outlet 98 extending through bin wall 12. The gases from the plenum chamber of bin B circulate from jacket inlet 96 through the space 92 and through a variable outlet 100 disposed on cover 102 of housing 86 (see FIG. 6) with the force of the positive pressure of the drying gases within the bin plenum chamber. Temperature-controlled gases from the bin plenum chamber will thus serve as a buffer in jacket 86 preventing the temperature of the atmosphere surrounding housing 86 from affecting the temperature of the gases sensed by element 82 and assuring accurate control results of the control unit 80.

Efficient operation of the assembly of FIGS. 6 and 7 requires an effectively gas-tight seal between the outer shell 36*a* of control unit 80 and the supporting section 14 with the exception, of course, of the gas passages 50. Also, jacket chamber 92 should be substantially gas-tight with the exceptions of inlet 96 and outlet 100 or other appropriate outlets.

The construction of FIG. 7 is particularly adapted for use where severe temperature gradients exist between the temperature of the gases surrounding the discharged grain and that of the atmosphere exterior of the bin B, such as would normally occur in the winter seasons in colder climates.

A non-insulated housing such as 36*b*, illustrated in FIG. 7*a*, also may be employed in conjunction with outer sensor housing 86*a*, particularly where the temperature gradients between the atmosphere exterior of the control unit 10*b* and the gases surrounding the discharged grain is not too great. The continuous passage of gas from the plenum chamber of the drying bin into housing inlet 96*a* and through the space 92*a* surrounding control unit 10*b* and to outlet 100*a* will impart to a sensor within unit 10*b* a controlled temperature which may be relied upon in calibrating or setting the control parameters for an appropriate humidity or temperature sensor control unit 40 or 80.

Figure 7B:
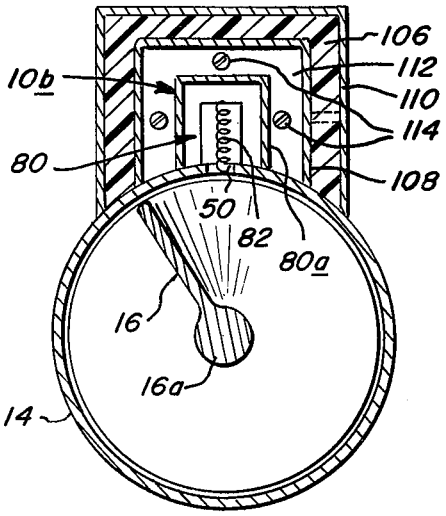

FIG. 7*b* illustrates a non-insulated control unit 10*b* surrounded by an outer layer of insulation 106 confined between inner and outer housings 108 and 110. Intervening chamber 112 may have an appropriate inlet and outlet for gas passage from the bin plenum chamber or may employ resistance heating elements 114 in the chamber 112 for imparting a desired temperature environment for the control 10*b*. An opening should be present in chamber 112 to allow bleeding of any excess pressure generated by expanding gases in the chamber to the chamber exterior.

It will thus be seen that improvements have been provided in control systems for drying bins which meet the aforestated objects.

While particular embodiments of this invention are show above, it will be understood, of course, that the invention is not limited thereto, since many modifications may be made by those skilled in the art, particularly in light of the teachings herein. It is contemplated, therefore, by the appended claims, to cover any such modifications as fall within the true spirit and scope of the invention.

What is claimed is:

1. In combination with a power-driven conveyor for discharging particulate material from a drying bin, said conveyor including a movable conveying means and a housing encompassing said conveying means wherein a drying gas may escape from such bin outward through said conveyor housing along with particulate material being conveyed by said conveyor; the improvement comprising said housing having a lateral gas passage positioned to be external to said bin, apparatus for controlling the operation of such conveyor including a control unit having actuating means including an element which is responsive to a condition of a gas therearound, said element being positioned externally of said conveyor housing and adjacent said lateral passage, a second housing covering said element and cooperating with said conveyor housing portion adjacent said lateral passage to form an enclosure for said element which is essentially impervious to passage of gas except for communication with the interior of said conveyor housing through said lateral passage, and means for essentially isolating such enclosure and said element therein from ambient atmospheric temperature conditions, whereby the control operation of said control unit is effected by the condition of the gases from said conveyor housing circulating into said second housing through said gas passage and independently of ambient temperatures of the atmosphere; said control unit being connected to control the power drive of said conveyor in accordance with predetermined conditions of such gas sensed by said element in said enclosure.

2. The combination of claim 1 wherein said element is a temperature responsive element.

3. The combination of claim 1 wherein said last-mentioned means comprises thermal insulation material within said second housing.

4. The combination of claim 1 in which said element responsive to the condition of the gas therearound is a humidity responsive element.

5. The combination of claim 1 wherein said last-mentioned means includes a jacket encompassing said second housing and defining a gas passage space between said second housing and said jacket, and means for conveying drying gas directly from said bin to and through said space.

6. In combination with a power driven conveyor for discharging particulate material from a drying bin, said conveyor including a movable conveying means and a housing encompassing said conveying means wherein a drying gas may escape from said bin outwardly through said conveyor housing along with particulate material being conveyed by said conveyor; the improvement comprising said housing having a lateral gas passage positioned to be external to said bin, apparatus for controlling the operation of such conveyor including a control unit having actuating means including an element which is responsive to a condition of gas therearound, said element being positioned externally of said conveyor housing and adjacent said lateral passage, a second housing covering said element and cooperating with a conveyor housing portion adjacent said lateral passage to form an enclosure for said element which is essentially impervious to passage of gas except for communication with the interior of said conveyor housing through said lateral passage, and means forming a jacket about said second housing within which a desired temperature is maintained, and means for effecting a desired temperature within said jacket whereby the control unit is insulated from the ambient atmosphere exterior of said jacket.

7. The combination of claim 6 in which said means for effecting a desired temperature in said jacket comprises a heated gas passing from said drying bin.

8. The combination of claim 6 in which the means for effecting a desired temperature in said jacket comprises resistance heating elements disposed in said jacket.

9. The combination of claim 6 in which said responsive element is encompassed by thermal insulation material in said second housing.

10. The combination of claim 6 in which a layer of thermal insulation is disposed over said outer jacket to insulate the atmosphere exterior of said jacket from said jacket interior.

* * * * *